US007806114B2

(12) United States Patent
Lee et al.

(10) Patent No.: US 7,806,114 B2
(45) Date of Patent: Oct. 5, 2010

(54) ELECTRIC OVEN

(75) Inventors: Yong Woo Lee, Seoul (KR); Wan Soo Kim, Gwangmyung-si (KR); Yong Soo Lee, Sihoong-si (KR); Seong Ho Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 1190 days.

(21) Appl. No.: 11/416,327

(22) Filed: May 3, 2006

(65) Prior Publication Data

US 2007/0125355 A1 Jun. 7, 2007

(30) Foreign Application Priority Data

Dec. 6, 2005 (KR) ..... 10-2005-0118190

(51) Int. Cl.
*F24C 15/04* (2006.01)

(52) U.S. Cl. ..... 126/198; 219/391

(58) Field of Classification Search ..... 126/198; 219/391

See application file for complete search history.

(56) References Cited

U.S. PATENT DOCUMENTS 3,561,423 A * 2/1971 Holtkamp et al. ..... 126/198
3,612,825 A * 10/1971 Chase et al. ..... 219/405
4,180,049 A * 12/1979 Carr et al. ..... 126/21 A
5,107,821 A * 4/1992 von Blanquet ..... 126/19 R
5,387,258 A * 2/1995 Puricelli ..... 126/21 A
2005/0133019 A1 6/2005 Kim et al.
2005/0223912 A1 10/2005 Kim et al.
2005/0224068 A1 10/2005 Kim et al.

FOREIGN PATENT DOCUMENTS

GB 2256921 12/1992

* cited by examiner

*Primary Examiner*—Steven B McAllister
*Assistant Examiner*—Sarah Suereth
(74) *Attorney, Agent, or Firm*—McKenna Long & Aldridge LLP

(57) ABSTRACT

An electric oven includes a cavity, a door rotatably installed at a front surface and including an air suction hole formed at one side of the outside thereof and an air discharge hole formed at one side of the inside thereof; and an air suction/discharge member mounted outside the cavity and allowing the indoor air to be sucked through the air suction hole and to be discharged to a lower side of the cavity.

11 Claims, 5 Drawing Sheets

ELECTRIC OVEN

BACKGROUND OF THE INVENTION

1. Field of the Invention

The present invention relates to an electric oven and more particularly, to a door cooling structure of an electric oven capable of preventing the high temperature air, which is generated at the time of oven driving, from being discharged toward a face of a user and of improving door cooling performance by improving a cooling passage of a door.

2. Description of the Related Art

In general, an electric oven is a cooking device that cooks food items using heat generated from a heating member such as a heater provided within a cavity. The electric oven is divided into a standing type and a built-in type. In detail, the standing type electric oven is independently installed at a place like a sink, and the built-in type electric oven is installed such that its cavity part is inserted in a wall of a kitchen.

FIG. 1 is a front view of the related art built-in type electric oven.

Referring to FIG. 1, the related art built-in type electric oven 1 is installed at a position spaced apart upward from a floor of a room at a predetermined interval.

In detail, the electric oven 1 includes a cavity (not shown) having a cooling chamber therein, a door 2 selectively opening a front side of the cavity, and a control panel 3 provided above the door and including a display part and an input part for inputting operation conditions.

In detail, an air suction hole 4 through which the indoor air is sucked is formed at an upper portion of the door 2. Also, a duck member (not shown) through which the air sucked through the air suction hole 4 flows and a fan for sucking the air are installed at an upper side of the cavity. The control panel 3 and the door 2 are spaced apart from each other at a predetermined interval, and an air discharge hole 5 is formed at the space therebetween. Accordingly, by rotation of the fan installed at an upper side of the cavity, the indoor air is sucked into the door through the air suction hole 4. The sucked air cools the door while passing in the door 2. The high-temperature air of which a temperature increases while passing within the door 2 flows along the duct member. The air flowing along the duct member is discharged to a room through the air discharge hole 5.

Here, in the built-in type electric oven 1, the air discharge hole 5 is placed commonly at a place as nearly high as a face or a neck of a user. Also, the air being discharged through the air discharge hole 5 is in a high-temperature state. Accordingly, if the user stands close to the front side of the electric oven 1, he or she may be burned by the high-temperature air being discharged from the air discharge hole 5.

Also, because the air suction hole 4 and the air discharge hole 5 are formed close to each other, the high-temperature air being discharged is sucked again through the air suction hole 4, thereby degrading the door cooling efficiency.

Also, when the air suction hole 4 is formed at a lower end of the door 2, the air introduced into the door ascends to cool the door, which deteriorates door cooling efficiency.

SUMMARY OF THE INVENTION

Accordingly, the present invention is directed to an electric oven that substantially obviates one or more problems due to limitations and disadvantages of the related art.

An object of the present invention is to provide an electric oven capable of increasing door cooling efficiency by improving a door cooling passage and of improving safety by preventing the high-temperature air from being discharged directly toward a facial area of a user.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an electric oven comprising: a cavity; a door rotatably installed at a front surface of the cavity and including an air suction hole at one side of it outer portion and an air discharge hole at one side of its inner portion; and an air suction/discharge member mounted outside the cavity and allowing the indoor air to be sucked through the air suction hole and to be discharged to a lower side of the cavity.

In another aspect of the present invention, there is provided an electric oven comprising: a cavity having a cooking space therein; a door rotatably installed at a front surface of the cavity and having an air suction hole and an air discharge hole at one side; a suction duct provided outside the cavity and having one end communicating with the air discharge hole; a fan assembly communicating with the other end of the suction duct and sucking the air; and a discharge duct having one end communicating with the fan assembly and allowing the air sucked through the suction duct to be discharged to a lower side of the cavity.

In a further another aspect of the present invention, there is provided an electric oven comprising: a door having therein a cooling passage bent plural times; a cavity having a front portion opened and closed by the door; and a suction/discharge member mounted outside the cavity and guiding the air heated while passing through the cooling passage to be discharged to a lower side of the door or the cavity.

By the electric oven according to the present invention, the high temperature air discharged to a room after cooling a door is prevented from being discharged directly to a facial area of a user, thereby improving the safety.

Also, a cooling passage within the door is improved, thereby increasing door-cooling efficiency. As an air suction hole and an air discharge hole are formed at different places, the high-temperature air being discharged is prevented from being re-introduced to the air suction hole.

Also, the air suction hole and the air discharge hole are better located for a more favorable consumer response to the product. In other words, by not forming the air suction hole and air discharge holes at the front portion of the door, the door is neatly finished to give the electric oven a high-quality appearance, to encourage consumers' desire to purchase the product.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The description will be made on a built-in type electric oven as an embodiment according to an aspect of the present invention.

Figure 1:
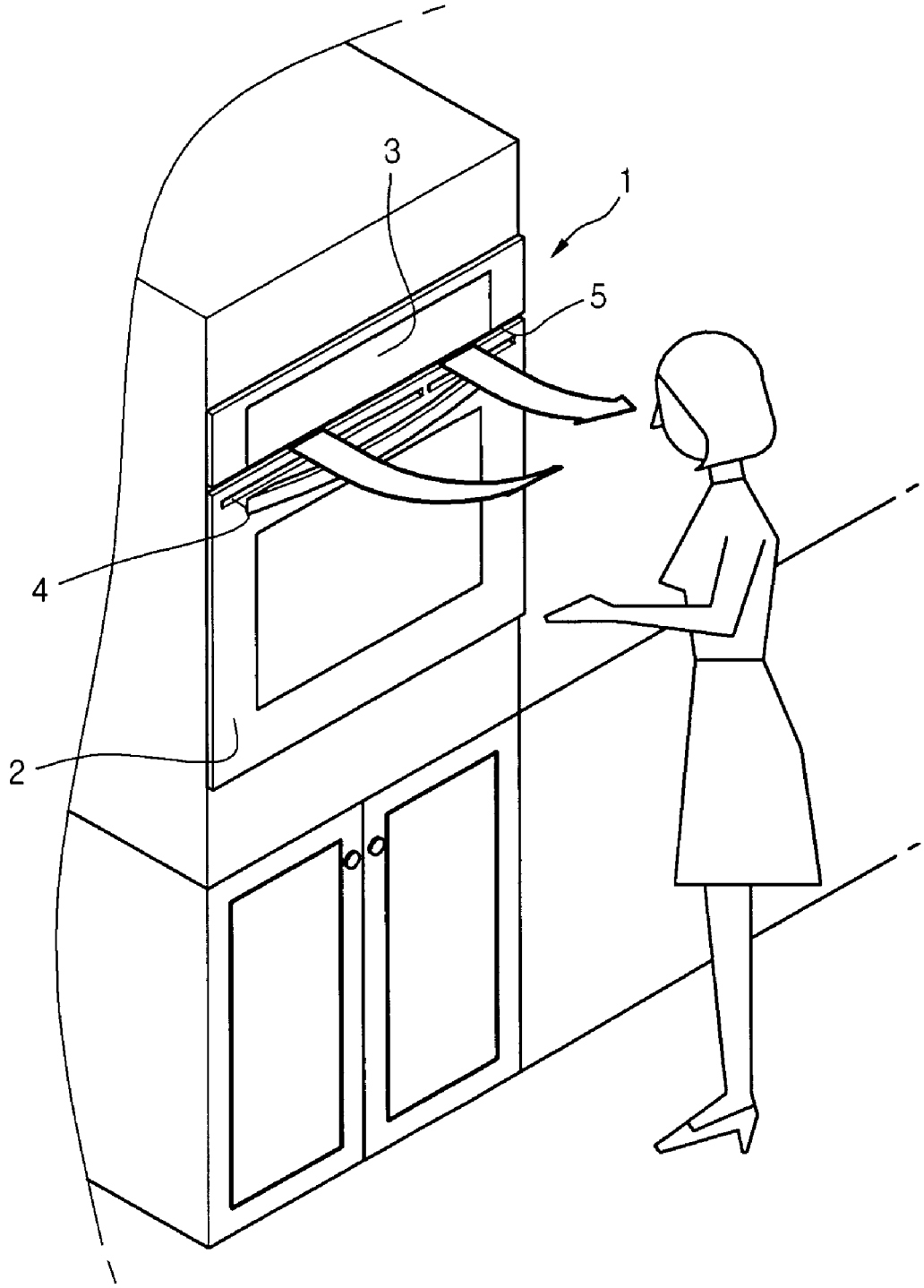
FIG. 1 is a front view of the related art built-in type electric oven.
Figure 2:
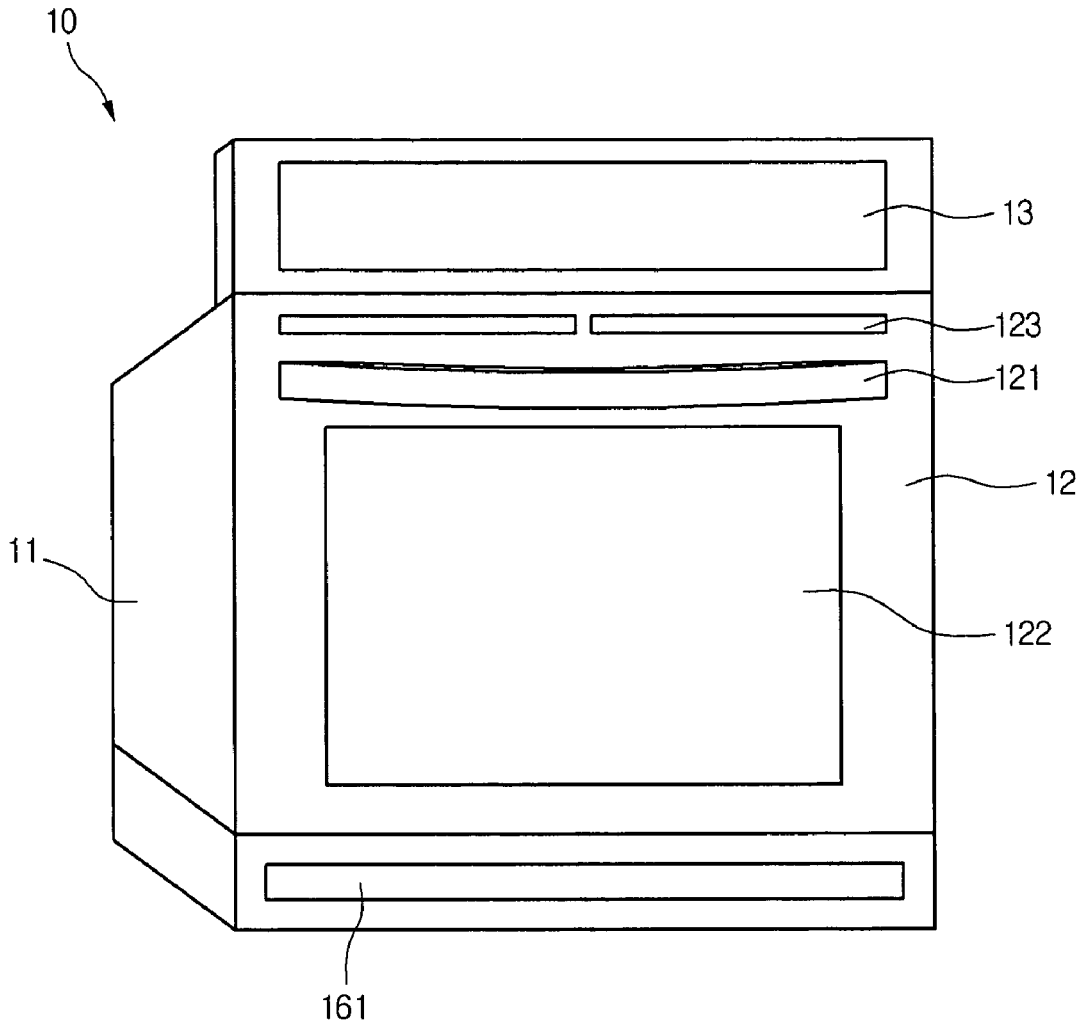
FIG. 2 is a perspective view of an exterior of an electric oven according to an aspect of the present invention.
Figure 3:
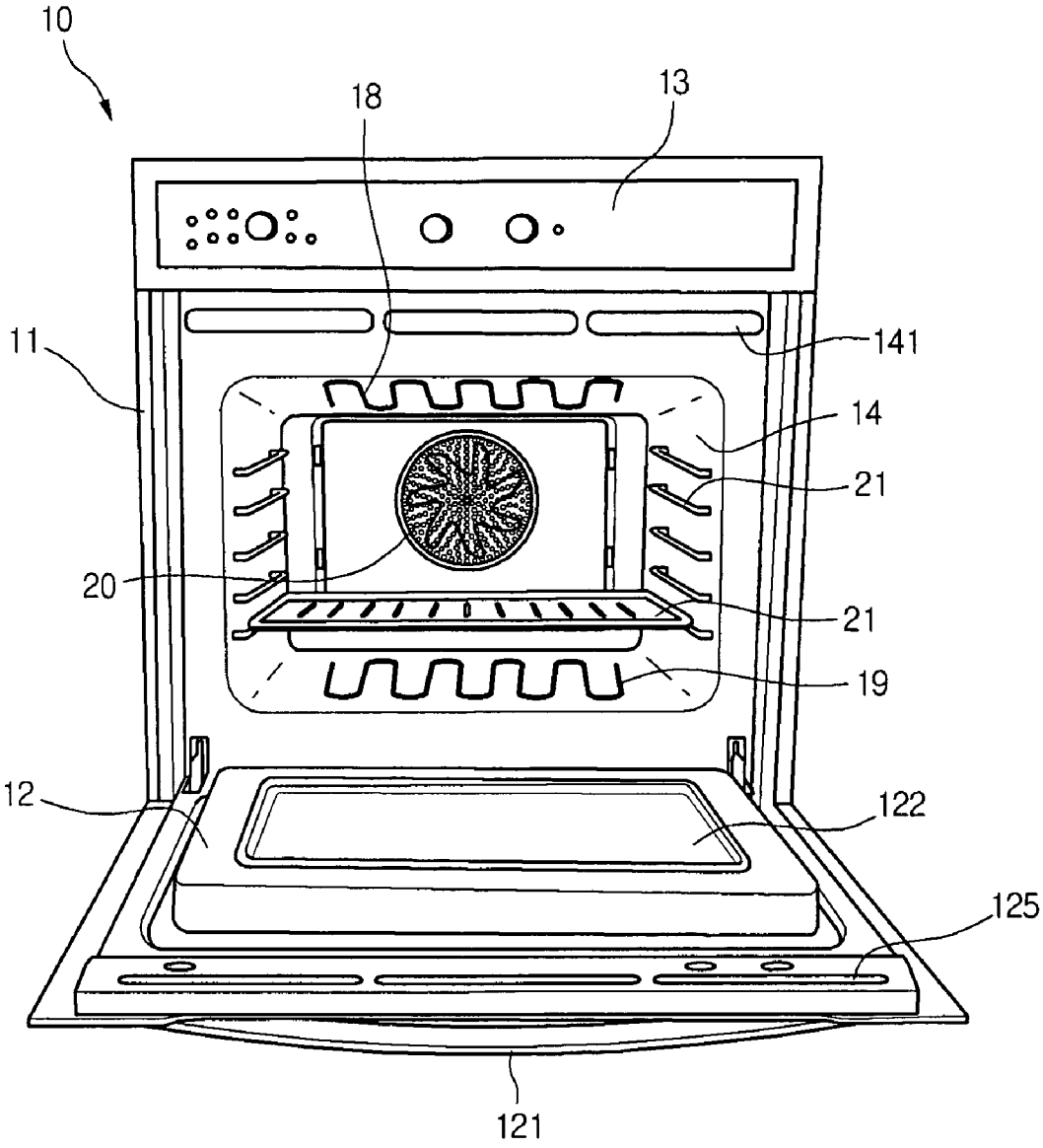
FIG. 3 is a perspective view of an internal structure of an electric oven according to an aspect of the present invention.

FIG. 2 is a perspective view of an exterior of an electric oven according to an aspect of the present invention, and FIG. 3 is a perspective view of an internal structure of an electric oven according to an aspect of the present invention.

Referring to FIGS. 2 and 3, the electric oven 10 according to the present invention includes a cabinet 11, a cavity 14 protected by the cabinet 11 and having a cooking chamber therein, a door 12 rotatably provided to a front side of the cavity 14, a control panel 13 installed above the cavity 14 and having operation buttons and a display window displaying an operational state, an upper heater 18 mounted to an inner upper surface of the cavity 14, a lower heater 19 mounted to an inner bottom surface of the cavity 14, an oven rack 21 inserted in the cavity 14 to be drawable, and a convection fan 20 mounted to an inner rear surface of the cavity 14 and circulating the air within the cavity 14.

In detail, a door handle 121 is provided at a front surface of the door 12, so as to allow a user to easily open and close the door 12. Within the door 12 a plurality of door glasses 122 are arranged at regular intervals. In detail, arranging the door glasses 122 at regular intervals contributes to preventing conduction of heat within the cavity to the outside. Also, the door glasses 122 are formed of a transparent or translucent material, thereby allowing food items within the cavity 14 to be seen from the outside during a cooking process.

Also, an air suction hole 123 through which the indoor air is sucked is formed at an upper surface of the door 12. An air passage through which the sucked indoor air flows is formed within the door, and the detailed description thereon will be made with reference to accompanying drawings.

An air discharge hole 125 through which the air sucked through the air suction hole 123 is discharged is formed at an inner upper surface of the door 12. A suction duct guiding hole 141 to which the air discharged through the air discharge hole 125 is introduced is formed at an upper side of a front portion of the cavity 14. A duct member and a fan for sucking the indoor air through the duct guiding hole 141 are installed at an upper surface of the cavity 14, and the description thereon will be made later. A discharge duct communication hole 161 for discharging to a room the air sucked through the air suction hole 123 is formed at a front surface of a lower end portion of the cavity 14.

The operation of the electric oven 10 having such a structure according to the present invention will now be described briefly.

First, a user opens the door 12 and draws out the oven rack 21 to place a food item thereon. Here, the food item may be placed directly on the oven rack 21 or may be put in a bowl and then placed thereon. Then, the user pushes the oven rack 21 into the cavity 14 and closes the door. Then, cooking conditions are inputted through an input unit provided in the control panel 13, and an operation button is pressed. Thus, power is applied to the upper heater 13 and/or the lower heater 19 within the cavity 14, and the food item is accordingly heated. Also, the convection fan 20 mounted at the rear side of the cavity 14 is rotated.

In detail, when the upper heater 18 and/or the lower heater 19 are heated to a high temperature, radiant heat is generated from the heater, and the radiant heat is radiated to the food item. By the rotation of the convection fan 20 the high-temperature air circulates within the cavity 14, heating the food item.

Here, when the inside of the cavity 14 is heated to a high temperature, heat is transmitted to and heats the door 12. Here, when a cooking process is started, a cooling fan mounted on an upper surface of the cavity 14 is driven, and the indoor air is introduced into the door 12 through the air suction hole 123. The air having been introduced into the door 12 receives heat from the door 12 to thereby cool the door 12, and is discharged through the air discharge hole 125. The discharged air is introduced to a duct member connected to the cooling fan through the suction duct guiding hole 141. Then, the air flows along the duct member and is discharged to a room through the discharge duct communication hole 16 formed at a lower end of the cavity 14.

A passage structure of the indoor air being sucked for the purpose of cooling the door 12 will now be described in more detail with reference to the accompanying drawing.

Figure 4:
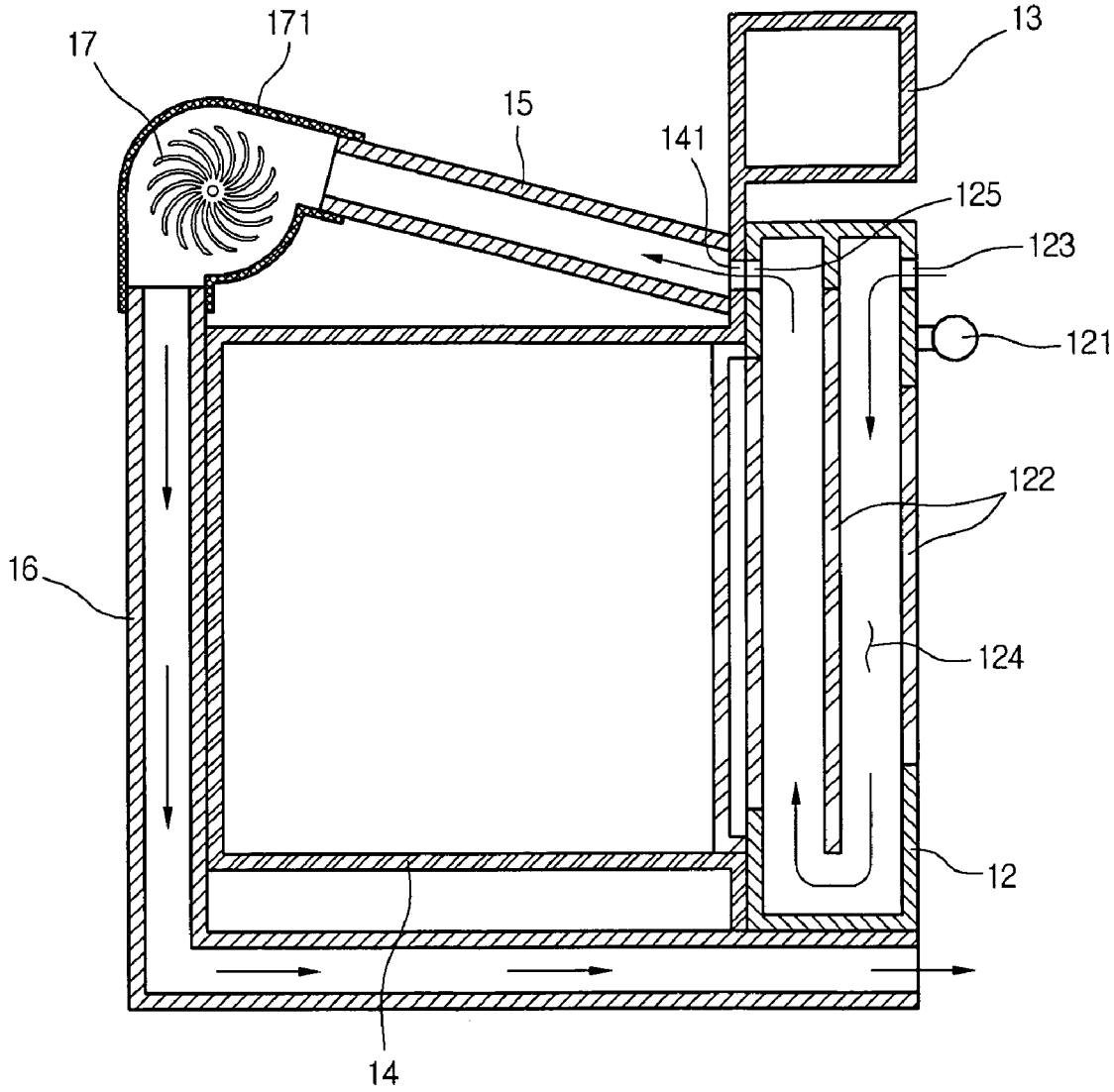
FIG. 4 is a side sectional view of an electric oven provided with a door cooling passage structure according to an aspect of the present invention.

FIG. 4 is a side-sectional view of an electric oven provided with a door cooling passage structure according to an aspect of the present invention.

Referring to FIG. 4, the electric oven 10 provided with the door cooling passage structure according to the present invention includes a cooling fan 17 installed at an upper side of the cavity 14, and a suction duct 15 and a discharge duct 16 guiding the flow of the indoor air sucked by the cooling fan 17.

In detail, the suction duct 15 is installed at an upper surface of the cavity 14, and has an end communicating with the suction duct guiding hole 141 formed at a front surface of the cavity 14. The cooling fan 17 is protected by a fan housing 171. One end of the fan housing 171 communicates with the suction duct 15 and its other end communicates with the discharge duct 16. The discharge duct 16 is installed downward along the rear surface of the cavity 14, is bent frontward at a lower end of the cavity 14, and continues to a front portion of the cavity 14. An end of the discharge duct 16 communicates with the discharge duct communication hole 161. The cooling fan 17 may be a cross flow fan that allows conversion of a flow direction of the air sucked along the suction duct 15.

Also, as for an internal structure of the door 12, an air suction passage 124 having a door glass 122 as a partition wall is formed within the door 12.

In detail, the air suction passage 124 has a shape allowing the indoor air sucked through the air suction hole 123 to descend and ascend. Such an air suction passage 124 is formed properly according to the number of door glasses 124 mounted within the door 12. In other words, as a plurality of door glasses are arranged within the door 12, the air suction passage 124 is formed as a meander line shape.

Here, the structure of the air suction passage allows the indoor air sucked through the air suction hole 123 to surely descend toward a lower side of the door 12 and also allows the indoor air ascending from a lower end of the door 12 to be discharged to the air discharge hole 125. Here, the indoor air sucked through the air suction hole 123 descends due to its low temperature as compared to a temperature of the air within the cavity 14, and the air having descended to a lower end portion ascends by being heated upon receiving heat from the cavity 14.

Also, the discharge duct 16 continues along an outer circumferential surface of the cavity 14, in detail, along a rear surface and a lower surface of the cavity 14. Namely, a portion where the indoor air is sucked into the door 12 and a portion where the air is discharged to a room along the discharge duct 16 are spaced apart from each other as far as possible. Thusly, the high-temperature air being discharged through the discharge duct 16 is prevented from being re-introduced into the door 12 through the air suction hole 123, thereby preventing degradation of the door cooling efficiency.

Figure 5:
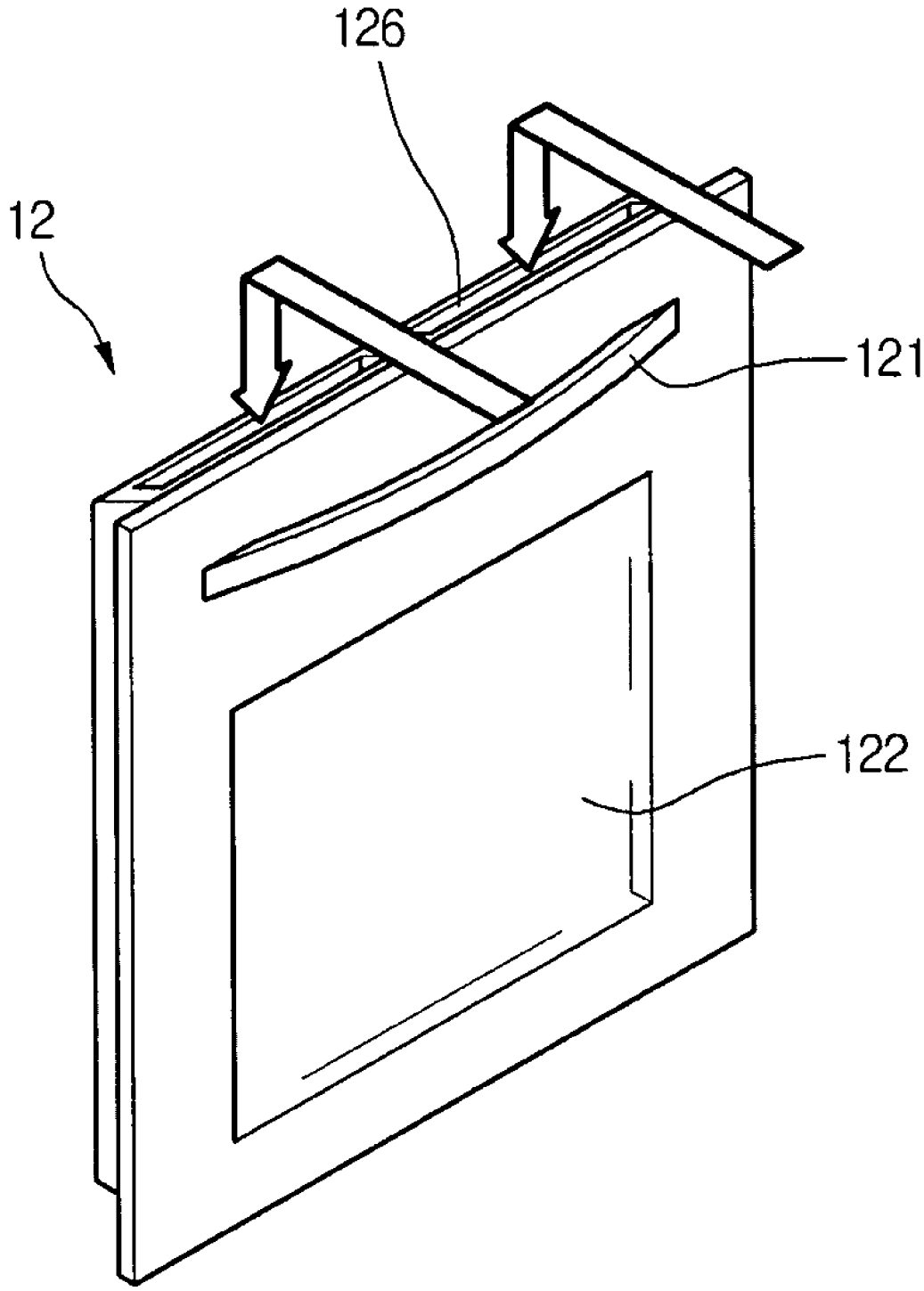
FIG. 5 is a schematic perspective view of another embodiment of a door of an electric oven according to an aspect of the present invention.

FIG. 5 is a schematic perspective view of another embodiment of a door of an electric oven according to an aspect of the present invention.

Referring to FIG. 5, the door 12 of the electric oven 10 according to the present invention has a door handle 121 at its front surface, and an air suction hole 126 is formed at an upper surface of the door 12.

In detail, forming the air suction hole 126 at an upper surface of the door 12 allows the air sucked into the door 10 to directly descend toward a lower side of the door 12, thereby reducing flow resistance. Also, an exterior of the door 12 becomes neat as compared in the case where the air suction hole is formed at a front side of the door 12.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An electric oven comprising:

a cabinet;

a cavity surrounded and protected by the cabinet;

a door rotatably installed at a front of the cavity to selectively open and close an opening of the cavity, the door including an air suction hole at an upper exterior portion of the door and an air discharge hole at an upper interior portion of the door, the door having an air suction passage inside the door which constitutes a shape allowing the air sucked through the air suction hole to descend to a lower end of the door and allowing the air to ascend from the lower end of the door to be discharged through the air discharge hole; and an air suction member mounted outside the cavity and including a fan assembly to drive the air discharged through the air discharge hole through a discharge port underneath the cavity.

2. The electric oven according to claim 1, wherein the air suction hole is formed at a front surface of the door.

3. The electric oven according to claim 1, wherein the air suction hole is formed at an upper surface of the door.

4. The electric oven according to claim 1, wherein the air suction hole is formed at a front surface of the door above a door handle.

5. The electric oven according to claim 1, wherein the air discharge hole is formed at a rear surface of the door.

6. The electric oven according to claim 5, wherein the cavity comprises a guiding hole at a front portion, the guiding hole communicating with the air discharge hole.

7. The electric oven according to claim 1, wherein the air suction/discharge member comprises:

a suction duct having one end communicating with the air discharge hole;

wherein the fan assembly communicates with the other end of the suction duct and sucks the indoor air; and a discharge duct allowing the air sucked through the suction duct to be discharged to a room.

8. The electric oven according to claim 7, wherein the fan assembly comprises:

a cooling fan sucking the air; and a fan housing encompassing the fan and communicating end portions of the suction duct and the discharge duct.

9. The electric oven according to claim 7, wherein the discharge duct extends along a rear surface of the cavity and extends forward below the cavity.

10. The electric oven according to claim 1, wherein the door comprises therein a plurality of door glasses arranged at predetermined intervals, and wherein the air suction passage is defined along a space between the door glasses.

11. The electric oven according to claim 7, wherein the cavity comprises a discharge hole at a lower end, the discharge hole allowing the air passing through the discharge duct to be discharged to a room.

* * * * *